US012024320B2

(12) United States Patent
Banholzer et al.

(10) Patent No.: US 12,024,320 B2
(45) Date of Patent: Jul. 2, 2024

(54) EJECTOR FOR A STRAPPING MACHINE

(71) Applicant: Mosca GmbH, Waldbrunn (DE)

(72) Inventors: Dieter Banholzer, Mosbach (DE); Felix Johannes van der Beek, Heidelberg (DE)

(73) Assignee: Mosca GmbH, Waldbrunn (DE)

( * ) Notice: Subject to any disclaimer, the term of this patent is extended or adjusted under 35 U.S.C. 154(b) by 25 days.

(21) Appl. No.: 17/952,641

(22) Filed: Sep. 26, 2022

(65) Prior Publication Data

US 2023/0095472 A1 Mar. 30, 2023

(30) Foreign Application Priority Data

Sep. 28, 2021 (DE) ..... 102021125067.6

(51) Int. Cl.
*B65B 13/06* (2006.01)
*B65B 13/10* (2006.01)
*B65B 13/22* (2006.01)

(52) U.S. Cl.
CPC ..... *B65B 13/10* (2013.01); *B65B 13/22* (2013.01)

(58) Field of Classification Search
CPC ..... B65B 13/06; B65B 13/22
USPC ..... 53/589
See application file for complete search history.

(56) References Cited

U.S. PATENT DOCUMENTS 4,244,773 A * 1/1981 Siebeck ..... B29C 66/49 100/6
5,249,518 A * 10/1993 Abrams ..... B65B 13/06 53/589
6,073,425 A * 6/2000 Chin-Chang ..... B65B 13/06 53/589
6,655,117 B2 * 12/2003 Hoshino ..... B65B 13/06 53/399
6,951,170 B2 * 10/2005 Lininger ..... B65B 13/18 100/29
8,327,758 B2 * 12/2012 Mosca ..... B65B 13/06 100/29
2002/0144489 A1 * 10/2002 Hoshino ..... B65B 13/32 53/589

(Continued)

FOREIGN PATENT DOCUMENTS

DE 2 155 367 5/1973
DE 29 06 425 A1 9/1979
DE 33 46 598 A1 10/1984

(Continued)

*Primary Examiner* — Andrew M Tecco

(74) *Attorney, Agent, or Firm* — Muirhead and Saturnelli, LLC

(57) ABSTRACT

A device for strapping objects with a flat strap includes a strap guide frame, a cover frame and an ejector. The strap guide frame has a channel that is open on a narrow side and a cover frame can be moved between a closed position and an open position relative to the strap guide frame. In the closed position, the strap guide covers the narrow side of the strap channel and in the open position, there is a gap. From a second side surface opposite of the open, narrow side, the ejector protrudes into the strap channel. The ejector is a flat component with two legs at an angle to one another, where the free end of the first leg is mounted to a mounting element and the free end of the second leg protrudes, with little play, into a flat opening that protrudes through the strap guide frame.

20 Claims, 5 Drawing Sheets

(56) References Cited

U.S. PATENT DOCUMENTS

2010/0147164 A1* 6/2010 Mosca ..... B65B 13/06
100/2

FOREIGN PATENT DOCUMENTS

| | | | |
|---|---|---|---|
| DE | 299 09 498 | U1 | 9/1999 |
| DE | 10 2018 127 052 | A1 | 4/2020 |
| DE | 10 2020 118 163 | A1 | 4/2021 |
| EP | 2 051 909 | B1 | 12/2010 |

* cited by examiner

EJECTOR FOR A STRAPPING MACHINE

TECHNICAL FIELD

The system described herein relates to a device for strapping objects using a flat strap.

BACKGROUND

European Patent EP 2 051 909 B1 discloses a strapping machine with a cover element that can be moved along a first side surface. The ejector used with the strapping machine is a pin that can be pushed into the strap channel. In DE 33 46 598 A1, the ejector is designed as a barbed hook which engages from above and reaches into a slot that separates the strap guide frame in the region of the strap channel. In U.S. Pat. No. 5,249,518 and DE 10 2020 118 163 A1, the ejector is designed as a swiveling arm. Publication DE 10 2018 127 052 A1 also describes a swivel-mounted ejector that moves into the strap channel when a cover element releases the strap channel. A strapping machine with an ejector that, as described above, protrudes into the strap channel from the second side surface of the strap guide frame is known from U.S. Pat. No. 6,073,425 A where the mounting element consists of a mounting spigot and a mounting plate that is screwed to the spigot and to which the ejection pin is mounted; the ejection-pin can be pushed into the strap channel via through holes and pushes the strap out of the strap channel. However, the design of U.S. Pat. No. 6,073,425 is complex and expensive due to the diversity of parts. Moreover, the thin pin that moves into the strap channel is not very stable and can be easily deformed.

SUMMARY OF THE INVENTION

It is desirable to further develop a strapping machine with an ejector that moves into the strap channel from the closed side in such a manner that the ejector can be manufactured easily and in a cost-efficient manner and that the ejector is reliable. Moreover, it is also desirable that the stability of the strap guide frame should be preserved.

According to the system described herein, an ejector is a flat component with two legs at an angle to one another, where the free end of the first leg is mounted to the mounting element and the free end of the second leg protrudes, with little play, into a flat opening that protrudes through the strap guide frame, extends across the strap channel, and has a height that is greater than the height of the strap channel transverse to the plane of the strap.

In other words, the ejector is a flat, L-shaped angle piece with two legs, the ends of which are connected to one another in a corner region preferably at a right angle. The L-shaped ejector can, for instance, be manufactured as a punched part made of steel sheeting. The free end of the first leg of the ejector is mounted to the mounting element. The first leg protrudes at a distance from the second surface of the strap guide frame toward the flat opening in the strap guide frame. The second leg of the L-shaped, flat component extends parallel to the movement direction in which the strap guide frame and cover frame can be moved relative to each other. The free end of the second leg protrudes, with little play, into said flat opening. When the strap guide is moved relative to the cover frame, the free end of the second leg is pushed into the flat opening. The flat opening protrudes through the strap guide frame and extends transverse in relation to the strap channel. The height of the flat opening and, consequently, the height of the free end of the second leg, is greater than the height of the strap channel transverse to the plane of the strap. That means that the free end of the second leg protrudes into the strap channel, at the top and bottom, and beyond the thickness of the strap so that the strap is safely pushed out of the strap guide channel.

The ejector, designed as a flat angle piece, is more rigid than a round ejection pin known from the prior art, the diameter of which is limited to the height of the strap channel. Both the mounting element and the L-shaped angle element, which forms the ejector, are extremely cost-efficient to manufacture and easy to install.

In practice, the strap guide frame may have protrusions opposite each other on both sides of the strap channel, the flat opening being arranged in the protrusions. In principle, the aim is to manufacture the strap guide frame as light and with as little material as possible. The strap guide frame is may be made of a plastic that is easy to process, has the stability required to guide the strap and allows for the strap to be transported through the strap channel with little friction. Since the flat opening extends transverse to the plane of the strap channel and is therefore higher than the strap channel, it is beneficial to equip the strap guide frame, in the region of the flat opening, with two butts or protrusions that are opposite each other so that the strap guide frame has the required stability despite the flat opening that extends transverse to the strap channel.

In practice, the strap guide frame may include straight and corner elements, wherein each straight element has a straight section of the strap channel, and each corner element has a bent section of the strap channel, and each corner element has a flat opening in the strap channel. This design of the strap guide frame allows for the use of standard components. The strap guide frame is, essentially, a closed frame which is only interrupted in the region of the strap drive and the strapping head that closes the strap loop. The size of the strap guide frame can vary depending on the design of the strapping machine. If the strap guide frame includes straight elements and corner elements, the straight elements can be manufactured as extrusion profiles of any length. The corner elements, which have the protruding, flat openings and, if applicable, the protrusions that are opposite each other in the region of the flat openings, can be manufactured in an injection molding process. The extruded, straight elements can be cut to length based on the design of the strapping machine so that strap guide frames with various dimensions can be manufactured using standardized components.

In practice, a strap drive can be configured to feed the strap into the strap channel in a feed direction, wherein the height of the strap channel continuously decreases in the feed direction in front of the flat opening, so that the strap channel opens into the flat opening with the minimum height, and the strap channel is widened in a funnel shape behind the flat opening in the feed direction so that the strap channel opens into the flat opening with the maximum height.

In other words, the strap channel is designed as a funnel shape in the feed direction in front of the flat opening and behind the flat opening. In front of the flat opening, the strap channel narrows from the standard height to a reduced height.

Behind the flat opening, the strap channel is higher than a standard height and the height decreases to the standard value. It must be noted that the height is measured perpendicular to the plane of the strapping strap inserted into the strap channel.

In practice, the mounting element can be a fastening spigot having a base portion that is connected to the cover frame. For instance, a screw connection or a rivet can be applied to attach the base of the fastening spigot to the cover frame.

In practice, the head portion of the fastening spigot can have a slot for receiving the free end of the first leg of the ejector. The head portion of the fastening spigot and the free end of the first leg of the ejector can have openings that are flush with each other through which a fastening pin protrudes. The slot for receiving the free end of the leg can be produced, e.g., cut or milled in, in the material of the fastening spigot at a specified depth. The narrow edge of the first leg of the ejector essentially lies flat against the bottom of the slot so that the ejector is fastened, essentially unable to pivot, to the fastening spigot by the fastening pin.

In practice, either the strap guide frame or the cover frame can be stationary. If the strap guide frame is stationary and the cover frame can move transversely to the strap guide frame, i.e., away from the strap guide frame, the strap located in the strap channel of the strap guide frame is pushed out through the open, narrow side of the strap channel by the ejectors that are mounted to the cover frame. In the open position of the cover frame, the strap is completely outside the strap channel. The strap loop created in this manner can be tightened by the strap drive until the strap loop tightly surrounds the object to be strapped. Then, the ends of the strap loop can be welded together.

If, however, the cover frame is stationary in relation to the strapping machine and the strap guide frame is moved, the strap remains in place when the strap guide frame is moving, while the strap channel of the strap guide frame is pushed over the ejector and the strap channel is consequently pulled away from the strap. In turn, in the open position, it is possible to tighten and seal the formed strap loop.

BRIEF DESCRIPTION OF DRAWINGS

Further practical designs and benefits of the system described herein are outlined below in context with the drawings.

DESCRIPTION OF VARIOUS EMBODIMENTS

Figure 1:
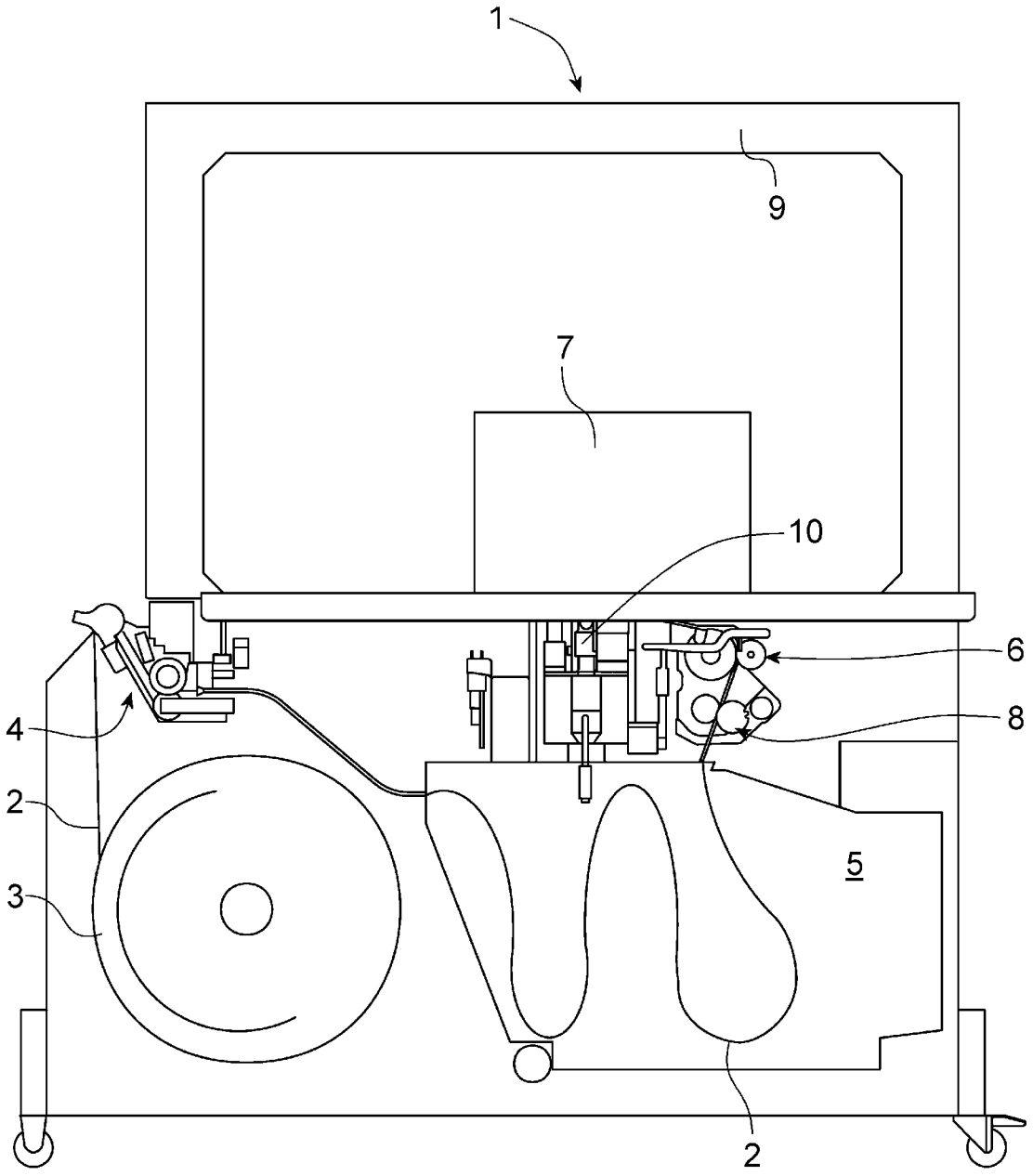
FIG. 1 shows a schematic side view of a strapping machine according to the system described herein.

The strapping machine 1 shown in FIG. 1 is used to strap objects 7 with a strap 2 that is fed from a supply roll 3 by a pull-in device 4 and fed into a strap magazine 5. From there, a strap feed device 6 feeds the strap through a tensioning unit 8 into a strap channel 15 in a strap guide frame 9 so that the strap 2 forms a loop. The strap 2 is then pulled back by the drive of the strap feed device 6, so that the strap loop lays taut against the object 7. Then, the tensioning device 8 is activated so that the strap loop is pulled around the object 7 at a specified high tension. The strap feed device 6 and the tensioning device 8 form the strap drive and can also be combined to form one drive unit.

Then, the taut loop is cut free from the strap reserve. The start of the loop is then connected to the end of the loop by a strapping head 10. In practice, the strapping head 10 consists of, e.g., a welding unit that welds the two ends of the strap loop together. The strapping head 10 welds the film-like plastic material used to make the strap 2. A conveyor with which the object 7 is transported into and out of the strapping zone within the strap guide frame 9 is not shown in FIG. 1.

Figure 2:
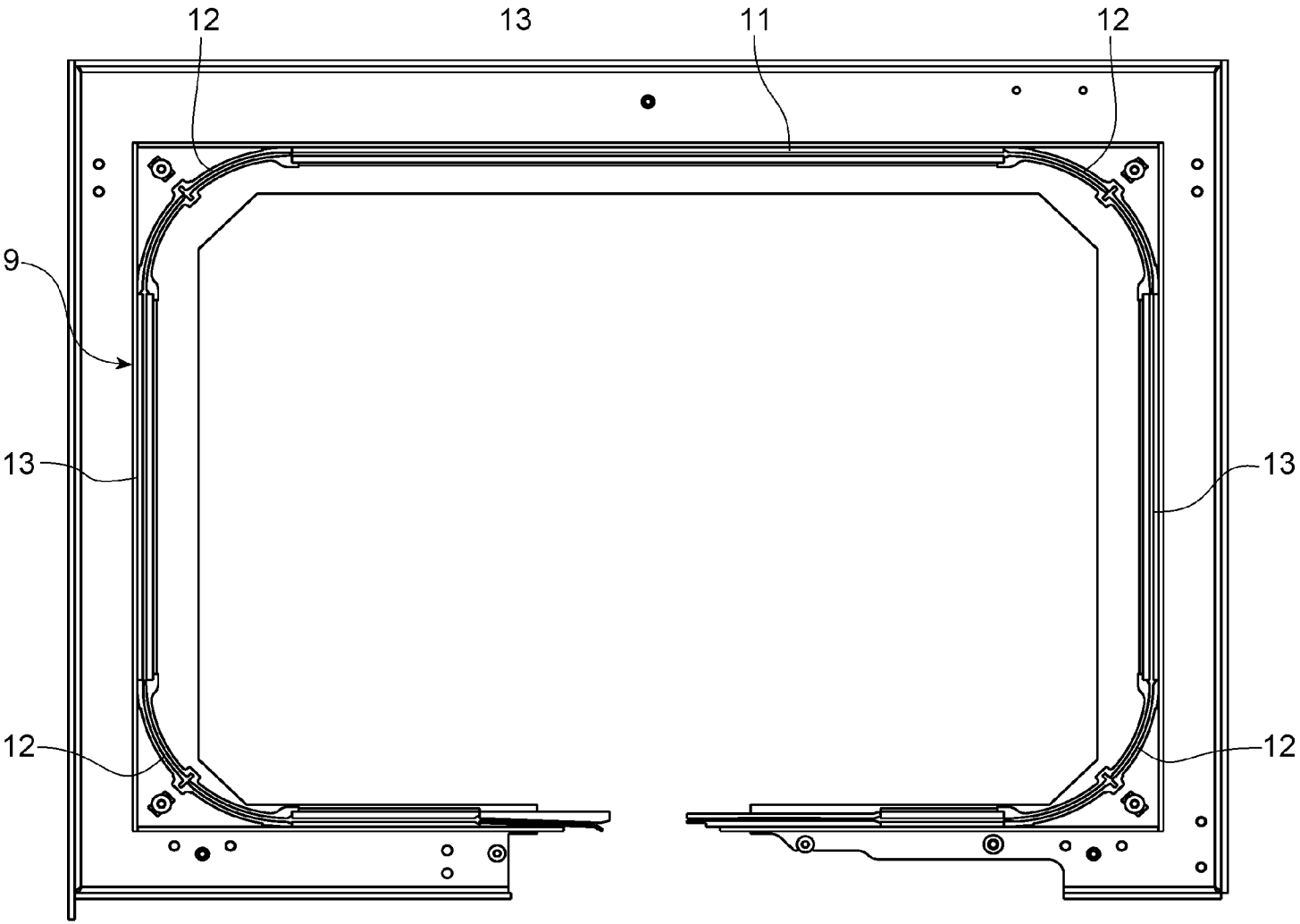
FIG. 2 shows a side view of a support frame with a strap guide frame according to the system described herein.

Only an external protective frame of the strap guide frame 9 is shown in FIG. 1. Within the external protective frame is a support frame 11 (see FIG. 2) on which elements 12, 13 are mounted which form the strap channel 15 of the strap guide frame 9 in which the strap 2 is guided. Moreover, closure devices for the strap channel 15 and ejectors 14 are arranged on the support frame 11. A support frame 11 for the strapping machine described here is shown in a side view in FIG. 2. The support frame 11 is made of a steel sheet that is beveled and laser-cut. Such a steel sheet is typically 3 to 6 mm thick.

Figure 3:
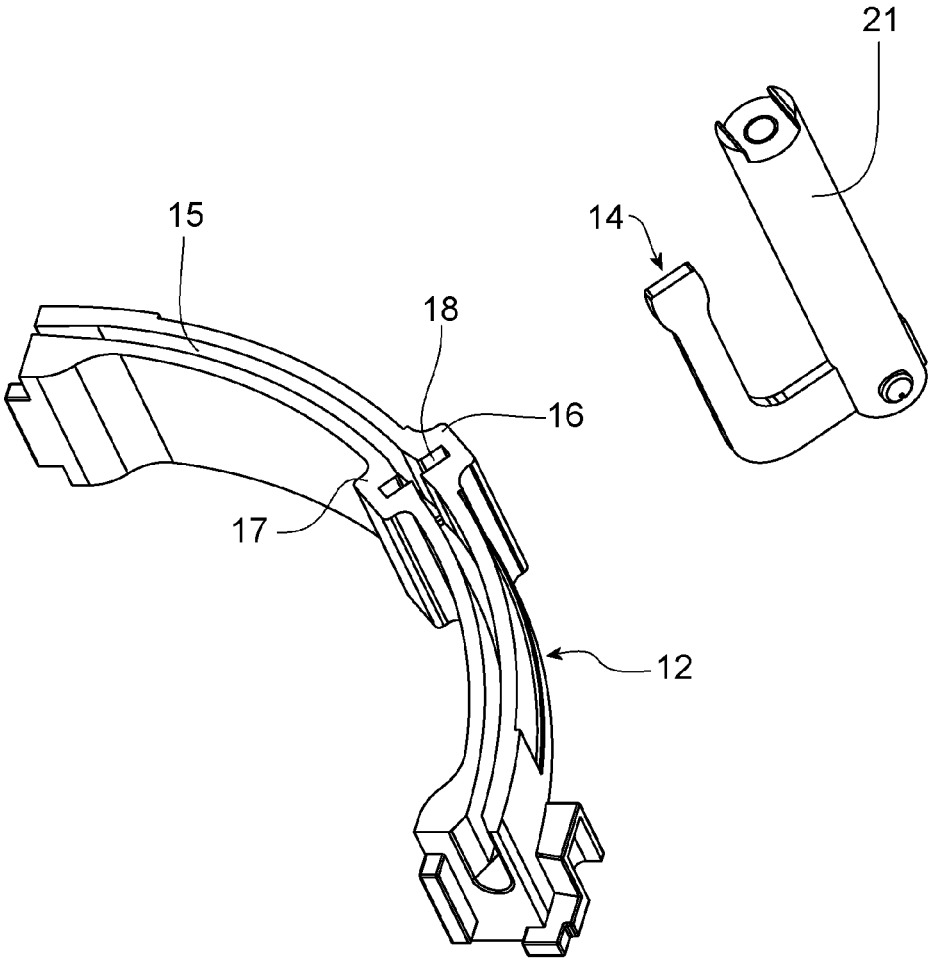
FIG. 3 shows a three-dimensional view of a corner element of a strap guide frame and an ejector according to the system described herein.

Corner elements 12 and straight elements 13 are mounted to the support frame 11. An enlarged view of the corner element 12 is shown in FIG. 3. The corner element 12 has a bent section of the strap channel 15. Each straight element 13 has a straight section of the strap channel 15.

FIG. 3 shows a three-dimensional view of a corner element 12 and an ejector 14 interacting with the corner element 12. The corner element 12 is a bent molded part made of plastic and has a bent section of the strap channel 15. The start of the bent section of the strap channel 15 visible in the top left of FIG. 3 is funnel-shaped, i.e., the section outlet is very high on the front side of the corner element 12 in a direction perpendicular to the strap plane which decreases continuously until the section outlet reaches a normal height of the bent strap channel 15. In the center of the corner element 12, two butts or protrusions 16, 17 can be seen which accommodate a flat opening 18 configured to receive the ejector 14.

Figure 4:
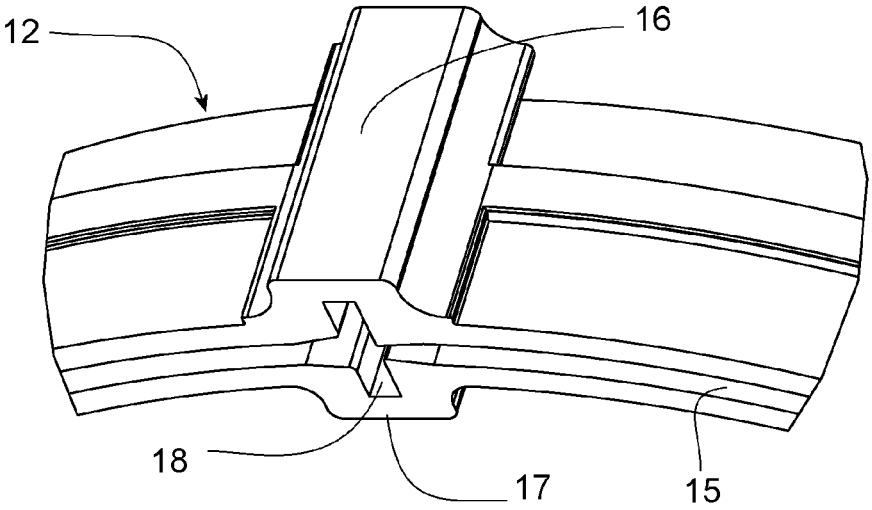
FIG. 4 shows an enlarged view of a portion of a corner element with an opening for an ejector according to the system described herein.

The region of the corner element 12 with the two protrusions 16, 17 is shown enlarged in FIG. 4. The protrusions 16, 17 are simple accumulations of the plastic material out of which the corner element 12 is made. The feed direction of the strap through the strap channel runs from left to right in FIGS. 3 and 4. In the region to the left of the flat opening 18, the strap channel 15 is funnel-shaped, i.e., a height of the strap channel 15 decreases perpendicular to the strap plane in a direction of the outlet into the flat opening 18. On the other side of the flat opening 18, the strap channel is very high, higher than a normal height of the strap channel. Consequently, the strap channel forms a sort of catch funnel for the strap 2 directly behind the flat opening 18.

Figure 6:
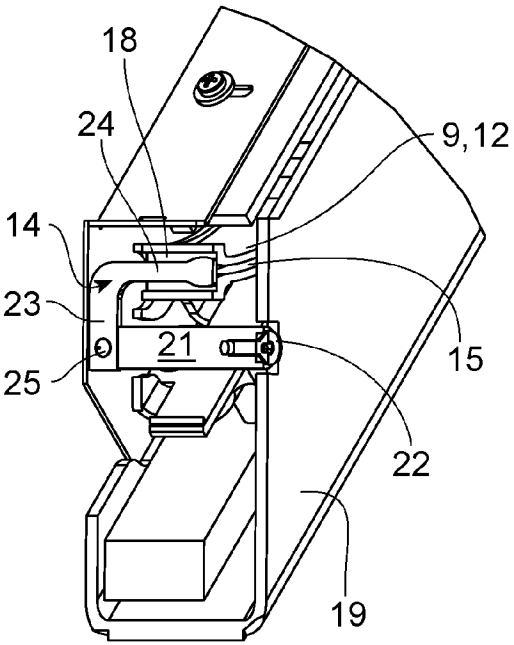
FIG. 6 shows a view of a strap guide frame in a region of an ejector in an open position corresponding to FIG. 5.
Figure 5:
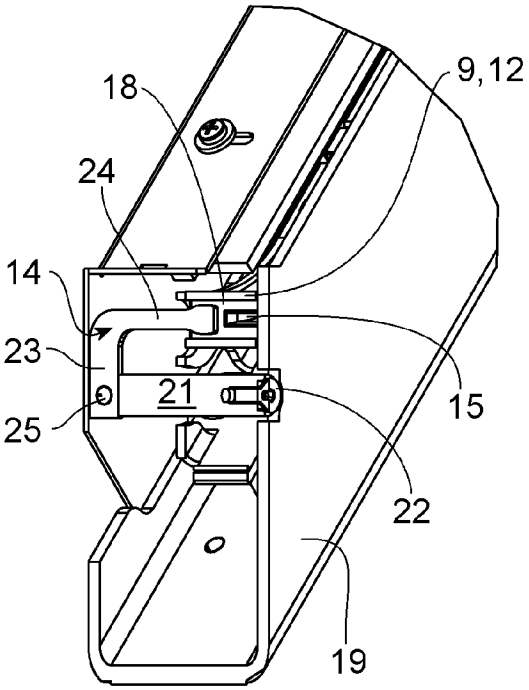
FIG. 5 shows a three-dimensional cross-section of a strap guide frame in a region of an ejector in a closed position according to the system described herein.

FIGS. 5 and 6 show cut, three-dimensional illustrations through the corner element 12 of the strap guide frame 9. The closed position is shown in FIG. 5. It is apparent that a cover frame 19 is assigned to the strap guide frame 9 that covers the side surface of the strap guide frame 9 with the open, narrow side of the strap channel 15. The strap guide frame 9, in FIGS. 5 and 6, the corner element 12 of the strap guide frame 9, can be moved in relation to the cover frame 19. FIG. 5 shows the closed position in which the side surface of the strap guide frame 9 abuts against one of the legs of the cover frame 19. FIG. 6 shows the open position in which the strap guide frame 9 with the strap channel is moved away from the cover frame. A gap forms between the strap guide frame 9 and the cover frame 19 in which the strap loop created by the strap lies after the strap guide frame 9 has moved away from the cover frame 19. To ensure that the strap 2 is moved out of the strap guide frame, the ejector 14 moves into the flat opening 18 while the strap guide frame 9 moves away from the cover frame 19. To this end, the ejector 14 is mounted to the head portion of a long, spigot-shaped mounting element 21, the base of which is attached to the cover frame 19 by a screw 22. The ejector 14 is designed as a flat, L-shaped angle piece and has a first leg 23 that is attached to the mounting element 21. To this end, the head portion of the mounting element 21 has a slot into which the end of the first leg 23 is inserted. A fastening pin 25 protrudes through flush openings in the head portion of the mounting element 21 on both sides of the slot and the first leg 23 of the ejector 14. The first leg 23 extends transversely to the strap plane and into the region of the flat opening 18 in the strap guide frame.

The second leg 24, which extends at a right angle to the first leg 23, extends at a distance from the mounting element 21, into the flat opening 18 on the corner element 12. In FIG. 5, it is particularly apparent that the height of the free end of the first leg 23, i.e. the span perpendicular to the plane of the strap or the strap channel in the region of the free end of the second leg 24 of the ejector 14, is significantly higher than the height of the strap channel. The flat opening 18 for receiving the ejector 14 consequently extends, on both sides, beyond the strap channel in the direction perpendicular to the strap plane.

FIGS. 5 and 6 show that this layout results in the strap 2 which is accommodated in the strap channel, being safely pushed out when the strap guide frame 9 with the strap channel is pushed away from the cover frame 19 in order to move to the open position (FIG. 6).

Of course, it is also possible to install the strap guide frame 9 on the machine frame so that the strap guide frame 9 is stationary and to move the cover frame 19 away from the side surface of the strap guide frame 9 into which the strap channel lets out.

The characteristics of the invention disclosed in this description, the drawings and the claims may be relevant, both individually and in any number of combinations, to the realization of the invention in its various design forms. The invention is not limited to the described design forms. It can be varied in the framework of the claims and taking the knowledge of the person skilled in the art into account.

The invention claimed is:

1. A device for strapping objects using a flat strap, comprising:

at least one strap guide frame;

a cover frame;

an ejector; and a flat strap channel, provided in the at least one strap guide frame, that is open on a narrow side that lets out into a first side surface of the strap guide frame, wherein the cover frame is moveable relative to the strap guide frame between a closed position and an open position so that the cover frame abuts against the first side surface of the strap guide frame in the closed position and covers the narrow side of the strap channel and, in the open position, the cover frame is at a distance from the narrow side of the strap channel, and wherein the ejector is mounted to a mounting element in such a manner that the ejector protrudes from a second side surface of the strap guide frame into the strap channel, wherein the second side surface is opposite the first side surface of the strap guide frame, the ejector being a flat component with two legs at an angle to one another, wherein a free end of the first leg is mounted to the mounting element and a free end of the second leg protrudes, with little play, into a flat opening that protrudes through a side of the strap guide frame and pushes the strap out of the strap channel when the cover frame is moved relative to the strap guide frame, the second leg extending across the strap channel and having a height that is greater than the height of the strap channel transverse to the plane of the strap.

2. The device according to claim 1, wherein the strap guide frame has protrusions that accommodate the flat opening and that are arranged opposite each other on both sides of the strap channel.

3. The device according to claim 2, wherein the strap guide frame includes straight elements and corner elements, wherein each straight element has a straight section of the strap channel and each corner element has a bent section of the strap channel and each corner element has a flat opening that receives the ejector.

4. The device according to claim 3, wherein a strap drive is configured to feed the strap into the strap channel in a feed direction, wherein the height of the strap channel continuously decreases in the feed direction in front of the flat opening, so that the strap channel opens into the flat opening with a minimum height, and is widened in a funnel shape behind the flat opening in the feed direction so that the strap channel opens into the flat opening with a maximum height.

5. The device according to claim 4, wherein the mounting element is a fastening spigot that has a base portion that is connected to the cover frame and has a head portion on which the ejector is mounted.

6. The device according to claim 5, wherein either the strap guide frame or the cover frame is stationary.

7. The device according to claim 3, wherein the mounting element is a fastening spigot that has a base portion that is connected to the cover frame and has a head portion on which the ejector is mounted.

8. The device according to claim 2, wherein a strap drive is configured to feed the strap into the strap channel in a feed direction, wherein the height of the strap channel continuously decreases in the feed direction in front of the flat opening, so that the strap channel opens into the flat opening with a minimum height, and is widened in a funnel shape behind the flat opening in the feed direction so that the strap channel opens into the flat opening with a maximum height.

9. The device according to claim 8, wherein the mounting element is a fastening spigot that has a base portion that is connected to the cover frame and has a head portion on which the ejector is mounted.

10. The device according to claim 2, wherein the mounting element is a fastening spigot that has a base portion that is connected to the cover frame and has a head portion on which the ejector is mounted.

11. The device according to claim 1, wherein the strap guide frame includes straight elements and corner elements, wherein each straight element has a straight section of the strap channel and each corner element has a bent section of the strap channel and each corner element has a flat opening that receives the ejector.

12. The device according to claim 11, wherein a strap drive is configured to feed the strap into the strap channel in a feed direction, wherein the height of the strap channel continuously decreases in the feed direction in front of the flat opening, so that the strap channel opens into the flat opening with a minimum height, and is widened in a funnel shape behind the flat opening in the feed direction so that the strap channel opens into the flat opening with a maximum height.

13. The device according to claim 12, wherein the mounting element is a fastening spigot that has a base portion that is connected to the cover frame and has a head portion on which the ejector is mounted.

14. The device according to claim 11, wherein the mounting element is a fastening spigot that has a base portion that is connected to the cover frame and has a head portion on which the ejector is mounted.

15. The device according to claim 1, wherein a strap drive is configured to feed the strap into the strap channel in a feed direction, wherein the height of the strap channel continuously decreases in the feed direction in front of the flat opening, so that the strap channel opens into the flat opening with a minimum height, and is widened in a funnel shape behind the flat opening in the feed direction so that the strap channel opens into the flat opening with a maximum height.

16. The device according to claim 15, wherein the mounting element is a fastening spigot that has a base portion that is connected to the cover frame and has a head portion on which the ejector is mounted.

17. The device according to claim 1, wherein the mounting element is a fastening spigot that has a base portion that is connected to the cover frame and has a head portion on which the ejector is mounted.

18. The device according to claim 1, wherein either the strap guide frame or the cover frame is stationary.

19. A device for strapping objects using a flat strap, comprising:

at least one strap guide frame;

a cover frame;

an ejector; and a flat strap channel, provided in the at least one strap guide frame, that is open on a narrow side that lets out into a first side surface of the strap guide frame, wherein the cover frame is moveable relative to the strap guide frame between a closed position and an open position so that the cover frame abuts against the first side surface of the strap guide frame in the closed position and covers the narrow side of the strap channel and, in the open position, the cover frame is at a distance from the narrow side of the strap channel, and wherein the ejector is mounted to a mounting element in such a manner that the ejector protrudes from a second side surface of the strap guide frame into the strap channel, wherein the second side surface is opposite the first side surface of the strap guide frame, the ejector being a flat component with two legs at an angle to one another, wherein a free end of the first leg is mounted to the mounting element and a free end of the second leg protrudes, with little play, into a flat opening that protrudes through the strap guide frame, extends across the strap channel and has a height that is greater than the height of the strap channel transverse to the plane of the strap, wherein the mounting element is a fastening spigot that has a base portion that is connected to the cover frame and has a head portion on which the ejector is mounted and wherein the head portion of the fastening spigot has a slot to take up the free end of the first leg of the ejector.

20. The device according to claim 19, wherein a fastening pin protrudes through the head portion of the fastening spigot and the free end of the first leg of the ejector.

* * * * *